United States Patent [19]

Caldwell et al.

[11] Patent Number: 5,002,211

[45] Date of Patent: Mar. 26, 1991

[54] SEWING ACCESSORY STORAGE DEVICE

[76] Inventors: Ruth E. Caldwell; Rose Caldwell, both of 465 Chestnut La., Desoto, Tex. 75115

[21] Appl. No.: 448,945

[22] Filed: Dec. 12, 1989

[51] Int. Cl.[5] ..... A41H 31/00

[52] U.S. Cl. ..... 223/107; 223/106; 223/108; 223/109 R; 223/120

[58] Field of Search ..... 223/106, 107, 108, 109 R, 223/120; 384/609, 614; 206/44.11, 45.11, 371

[56] References Cited

U.S. PATENT DOCUMENTS

| | | | |
|---|---|---|---|
| D. 176,148 | 11/1955 | Kruft . | |
| 778,379 | 12/1904 | Slatz | 384/609 |
| 809,274 | 1/1906 | Epley | 223/106 |
| 815,067 | 3/1906 | Commars | 223/106 |
| 848,409 | 3/1907 | Thompson | 223/106 |
| 1,277,956 | 10/1918 | Leach | 223/106 |
| 1,289,448 | 12/1918 | Herbert | 223/106 |
| 1,454,639 | 5/1923 | Haines | 223/107 |
| 2,103,571 | 12/1937 | Watson . | |
| 2,232,873 | 2/1941 | Storms . | |
| 3,197,096 | 7/1965 | Marocchio | 223/107 |
| 3,377,035 | 4/1968 | Sparr | 223/106 |
| 4,111,341 | 9/1978 | Carrozo . | |
| 4,319,703 | 3/1982 | Gann . | |
| 4,763,855 | 8/1988 | DiVincenzo | 223/106 |

*Primary Examiner*—W. C. Reynolds
*Assistant Examiner*—Bibhu Mohanty
*Attorney, Agent, or Firm*—Jerry T. Kearns

[57] ABSTRACT

A sewing accessory storage device includes a stationary base plate and rotatably mounted upper and lower storage trays secured in spaced relation on vertical hollow cylindrical columns. The lower storage tray has a plurality of radial dividers which provide separate storage compartments for miscellaneous items. The upper storage tray has a plurality of vertical spindles for storing bobbins and spools of thread. Scissor storage pockets are provided in the vertical column. A pin cushion having an arcuate convex curvature is secured at a top end of the vertical column.

10 Claims, 4 Drawing Sheets

SEWING ACCESSORY STORAGE DEVICE

BACKGROUND OF THE INVENTION

1. Field of the Invention

The present invention relates to sewing accessory storage devices, and more particularly pertains to an improved sewing accessory storage device having a carousel type construction and including specialized storage receptacles for storing a large number of sewing accessory items in a highly organized manner.

2. Description of the Prior Art

Various types of sewing accessory storage devices are known in the prior art. A typical example of such a sewing accessory storage device is to be found in U.S. Pat. No. 2,103,571, which issued to F. Watson on Dec. 28, 1937. This patent discloses a portable sewing kit having a generally cylindrical pocket for storing thread spools. U.S. Pat. No. 2,232,873, which issued to R. Storms on Feb. 25, 1941, discloses a sewing kit for storing prethreaded needles and threaded spools. U.S. Design Pat. No. 176,148, which issued to H. Kruft on Nov. 22, 1955, discloses a sewing kit having a cylindrical disk configuration. U.S. Pat. No. 4,111,341, which issued to C. Carrozo on Sept. 5, 1978, discloses a sewing accessory storage case formed by two hingedly connected shallow rectangular trays. A plurality of storage pockts and hooks are utilized for storing yarn and other accessory items. U.S. Pat. No. 4,319,703, which issued to B. Gann on Mar. 16, 1982, discloses a sewing accessory organizer in the form of a flexible ring type notebook. Flexible sheets have slots for the reception of various accessory items.

While the above mentioned devices are directed to sewing accessory storage devices, none of these devices are formed as a carousel type organizer including a lower storage tray having a plurality of radiallY extending dividers, an upper storage tray having a plurality of vertical bobbing storage spindles, and a vertical column including a plurality of scissor storage pockets and terminating at a top end in a pin cushion. Inasmuch as the art is relatively crowded with respect to these various types of sewing accessory storage devices, it can be appreciated that there is a continuing need for and interest in improvements to such sewing accessory storage devices, and in this respect, the present invention addresses this need and interest.

SUMMARY OF THE INVENTION

In view of the foregoing disadvantages inherent in the known types of sewing accessory storage devices now present in the prior art, the present invention provides an improved sewing accessory storage device. As such, the general purpose of the present invention, which will be described subsequently in greater detail, is to provide a new and improved sewing accessory storage device which has all the advantages of the prior art sewing accessory storage devices and none of the disadvantages.

To attain this, a representative embodiment of the concepts of the present invention is illustrated in the drawings and makes use of a sewing accessory storage device which includes a stationary base plate and rotatably mounted upper and lower storage trays secured in spaced relation on vertical hollow cylindrical columns. The lower storage tray has a plurality of radial dividers which provide separate storage compartments for miscellaneous items. The upper storage tray has a plurality of vertical spindles for storing bobbins and spools of thread. Scissor storage pockets are provided in the vertical column. A pin cushion having an arcuate convex curvature is secured at a top end of the vertical column.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sewing accessory storage device which has all the advantages of the prior art sewing accessory storage devices and none of the disadvantages.

It is another object of the present invention to provide a new and improved sewing accessory storage device which may be easily and efficiently manufactured and marketed.

It is a further object of the present invention to provide a new and improved sewing accessory storage device which is of a durable and reliable construction.

An even further object of the present invention is to provide a new and improved sewing accessory storage device which is susceptible of a low cost of manufacture with regard to both materials and labor, and which accordingly is then susceptible of low prices of sale to the consuming public, thereby making such sewing accessory storage devices economically available to the buying public.

Still yet another object of the present invention is to provide a new and improved sewing accessory storage device which provides in the apparatuses and methods of the prior art some of the advantages thereof, while simultaneously overcoming some of the disadvantages normally associated therewith.

Still another object of the present invention is to provide a new and improved sewing accessory storage device for providing a carousel type organizer for maintaining a large number of sewing accessory items in a well organized fashion for convenient use.

Yet another object of the present invention is to provide a new and improved sewing accessory storage device having a stable, inexpensive modular construction.

Even still another object of the present invention is to provide a new and improved sewing accessory storage device including a plurality of rotatable storage trays, scissor storage pockets, and a pin cushion in a single unitized carousel type organizer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
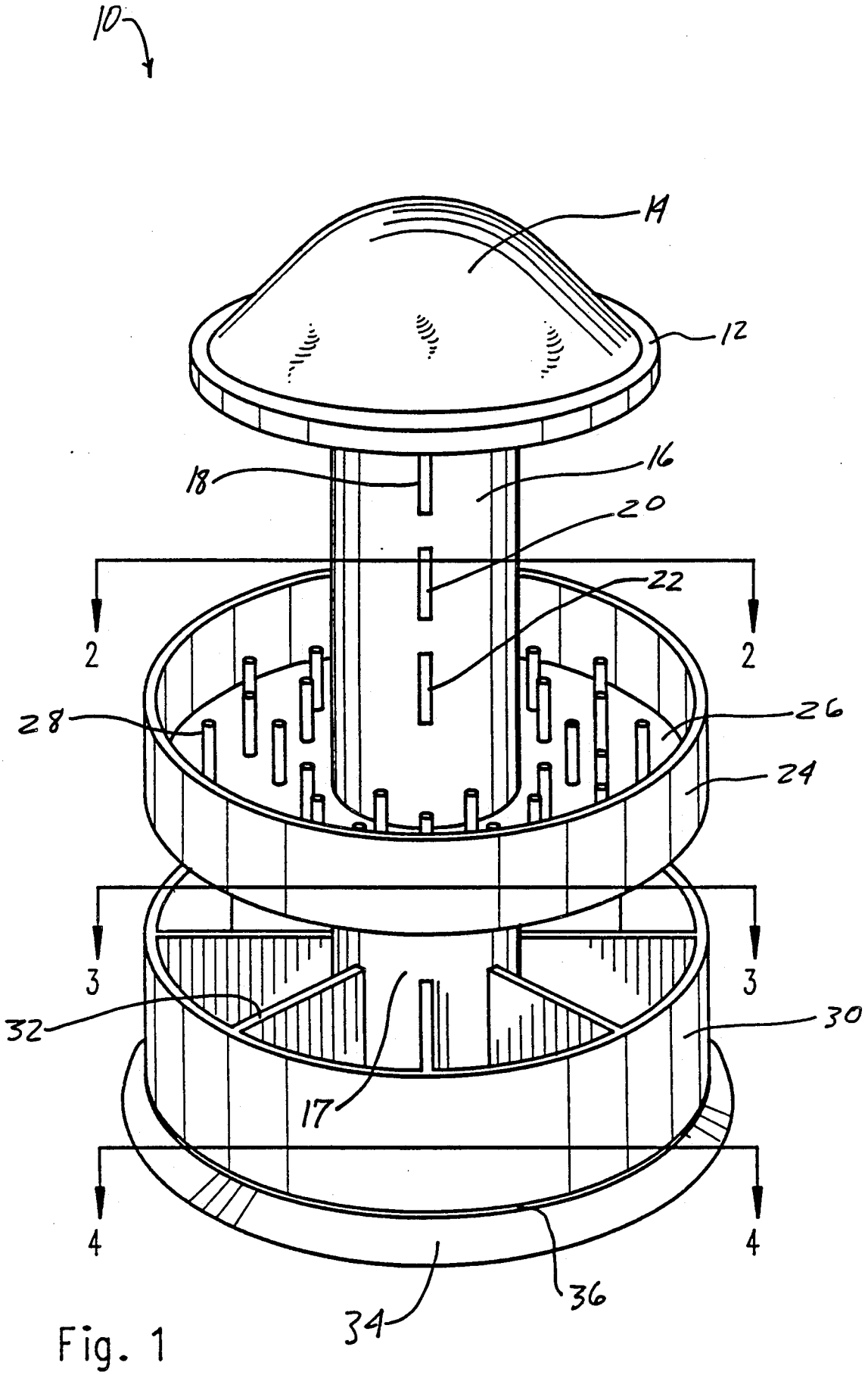
FIG. 1 is a perspective view of the sewing accessory storage device according to the present invention.

With reference now to the drawings, and in particular to FIG. 1 thereof, a new and improved sewing accessory storaee device embodYing the principles and concepts of the present invention and generally designated by the reference numeral 10 will be described.

More specifically, it will be noted that the first embodiment 10 of the invention includes a circular pin cushion mounting plate 12 having an arcuately curved convex pin cushion 14 secured thereon. The pin cushion mounting plate 12 is disposed at an upper end of an upper hollow cylindrical column 16. A plurality of pockets 18, 20 and 22 are formed in the upper column 16 and are dimensioned for insertion of the blade portion of conventional scissors. An upper cylindrical storage tray 24 has a circular bottom wall or floor 26. A plurality of vertical stationary spindles or posts 28 are spaced about the bottom wall 26, and are adapted to receive conventional sewing bobbins or thread spools. A lower hollow cylindrical column 17 extends downwardly from the upper storage tray 24 and is connected to a lower cylindrical storage tray 30. The lower storage tray 30 has a plurality of vertical, radially extending circumferentially spaced dividers 32 which form a plurality of separate compartments for the storage of miscellaneous sewing accessory items. A frusto conical stationary base plate 34 has a circular top surface 36. A bearing assembly is centrally secured on the top surface 36 and serves to mount the lower storage tray 30, the lower column 17, the upper storage tray 24, the upper column 16 and the pin cushion 14 for concurrent rotation with respect to the base plate 34. The details of the bearing assembly will be described subsequently.

Figure 2:
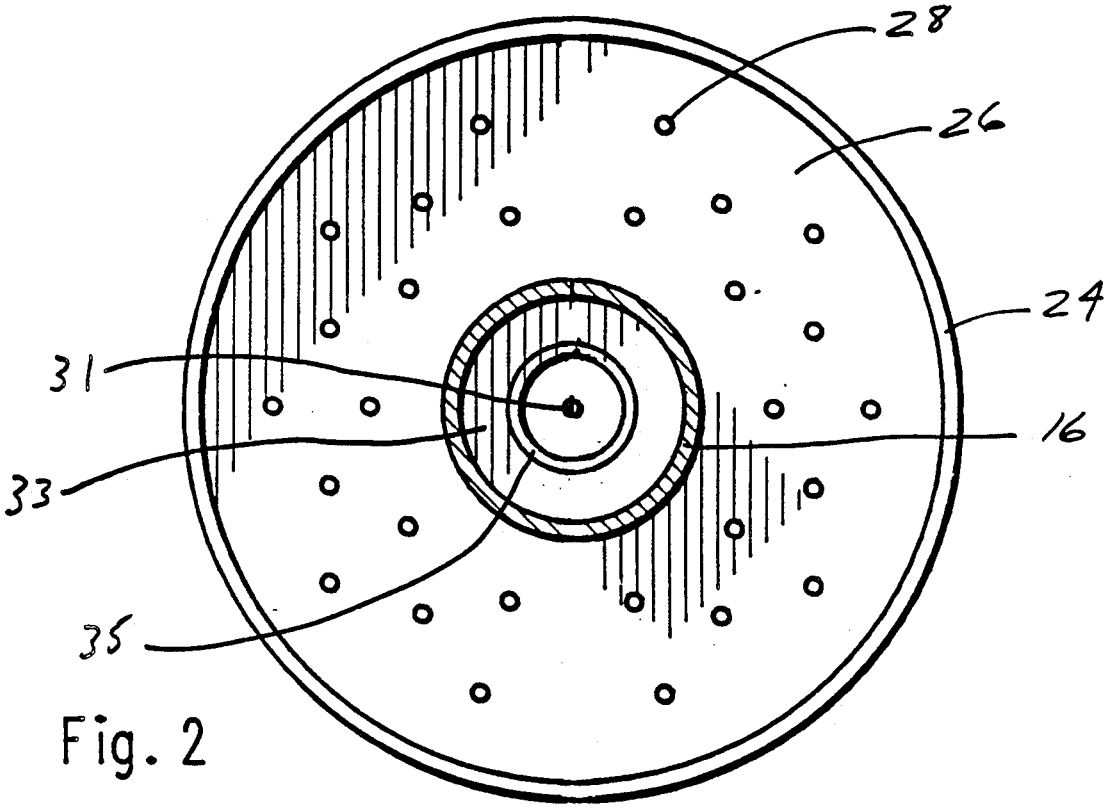
FIG. 2 is a transverse cross sectional view, taken along line 2—2 of FIG. 1.

FIG. 2 is a transverse cross sectional view, taken along line 2—2 of FIG. 1, which illustrates an axial rod section 31 extending through the bottom wall 26 of the upper storage tray 24. An upstanding cylindrical boss 35 extends upwardly from the bottom wall 26 and is received in close fitting frictional engagement through a circular aperture formed in the bottom end wall 33 of the upper column 16.

Figure 3:
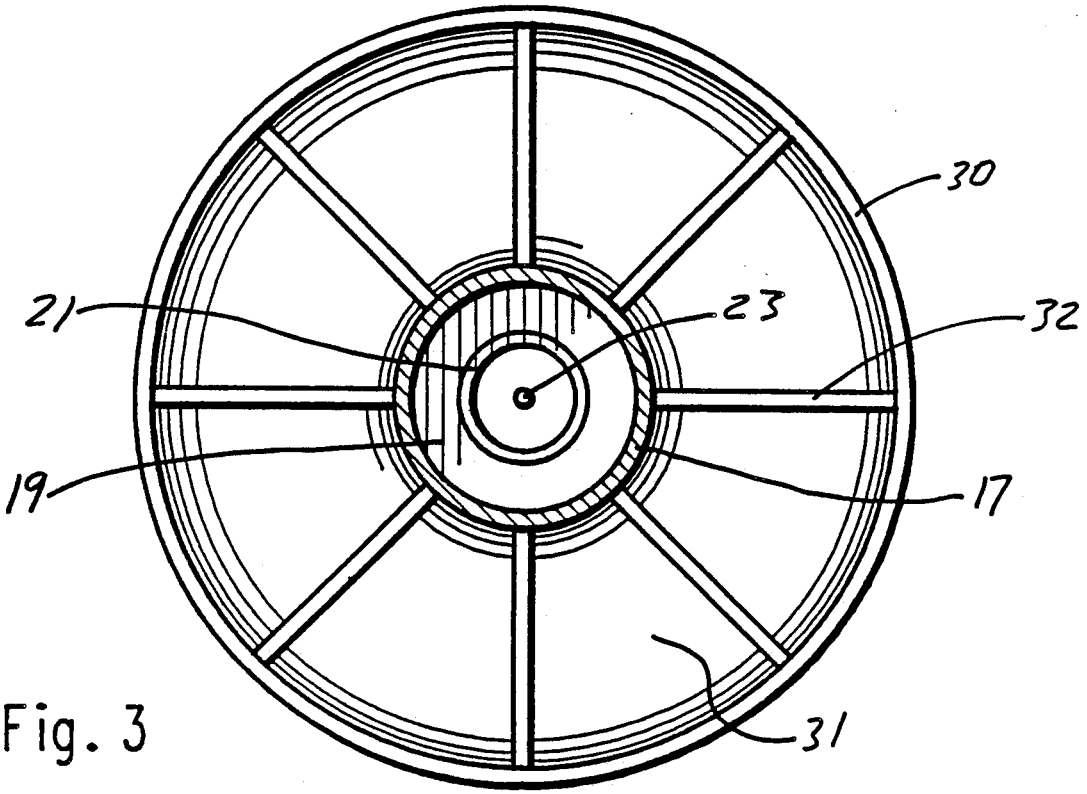
FIG. 3 is a transverse cross sectional view, taken along line 3—3 of FIG. 1.

FIG. 3 is a transverse cross sectional view, taken along line 3—3 of FIG. 1, which illustrates an axial rod section 23 received through the floor 31 of the lower storage tray 30. An upwardly extending cylindrical boss 21 is formed on the floor 31, and is received in close fitting frictional engagement through a circular aperture provided in a bottom end wall 19 of the lower vertical column 17.

Figure 4:
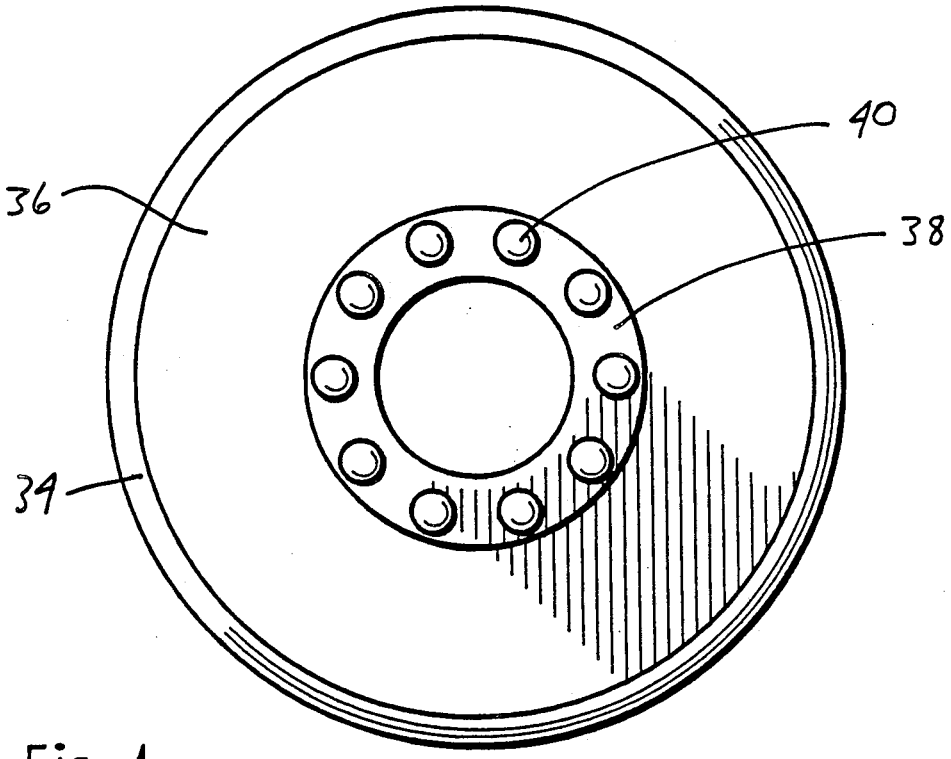
FIG. 4 is a transverse cross sectional view, taken along line 4—4 of FIG. 1.

FIG. 4 is a transverse cross sectional view, taken along line 4—4 of FIG. 1, which illustrates a bearing cage 38 upon which a plurality of ball bearings 40 are rotatably mounted, in a conventional manner.

Figure 5:
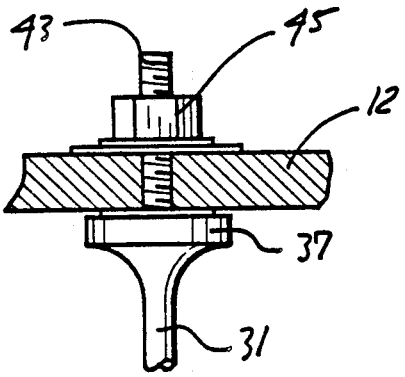
FIG. 5 is a cross sectional detail view, illustrating the assembly details of the pin cushion mounting plate.

FIG. 5 illustrates the circular pin cushion mounting plate 12 secured to an upper flared end 37 of an upper axial rod section 31 by a threaded stud 43 in cooperation with a nut 45.

Figure 6:
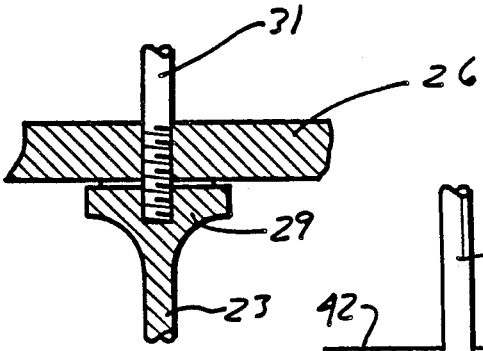
FIG. 6 is a cross sectional detail view illustrating the assembly details of the upper storage tray.

FIG. 6 illustrates a lower end of the axial rod section 31 received through the bottom wall 26 of the upper storage tray and in threaded engagement with an upper flared end 29 of an axial rod section 23.

Figure 7:
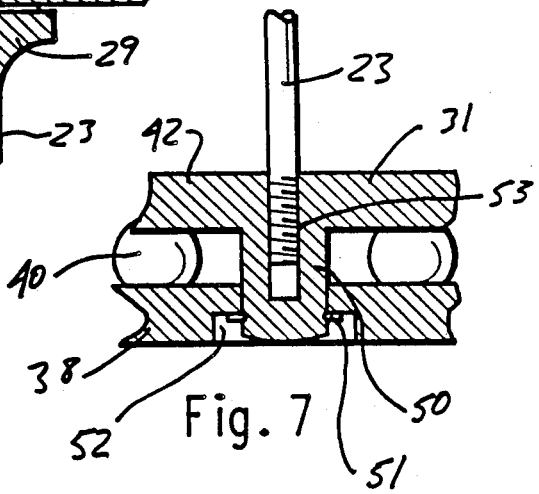
FIG. 7 is a cross sectional detail view illustrating the construction of the rotary bearing assembly.

FIG. 7 illustrates the stationary bearing cage 38 and a rotatable bearing track plate 42 supported for rotation by conventional rotatable ball bearings 40. The bearing track plate 42 is preferably secured to the bottom wall or floor 31 of the lower storage tray. The bearing track plate 42 includes a downwardly extending cylindrical stub portion 50 received for rotation through a central journal bore provided in the bearing cage member 38. An enlarged diameter recess 52 may be provided to allow a snap retaining ring 51 to be installed in a circumferential groove formed on the cylindrical stub portion 50. A lower end of the axial rod section 23 may be disposed in threaded engagement within a threaded bore 53 provided in the cYlindrical stub portion 50. It should be noted that the cylindrical stub portion 50 is an optional alternative, and may be omitted while still retaining the salient rotatable connection between the various components.

Figure 8:
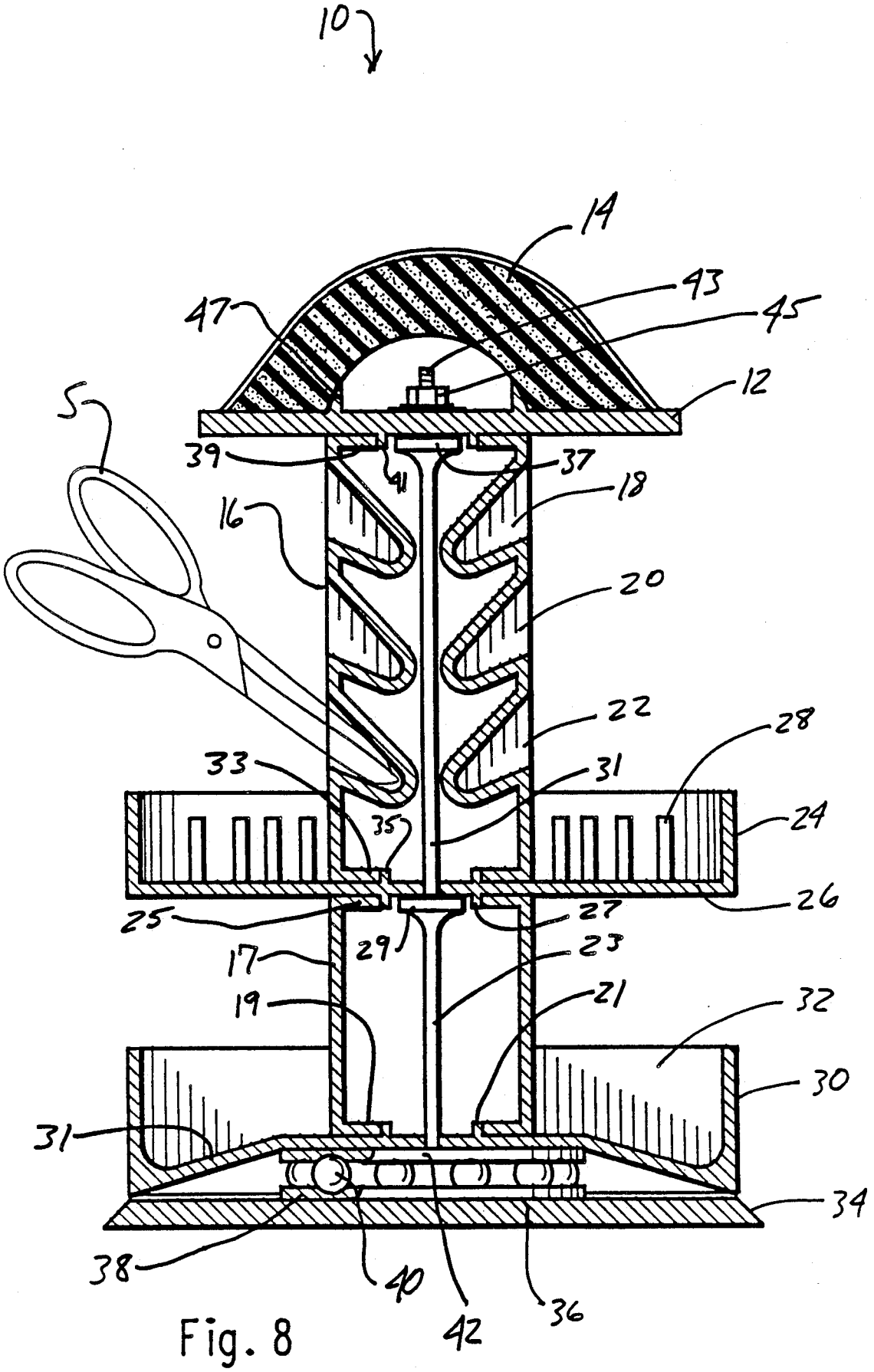
FIG. 8 is a longitudinal cross sectional view further illustrating the construction of the sewing accessory storage device according to the present invention.

FIG. 8 is a longitudinal cross sectional view, which illustrates the manner of storing a conventional pair of scissors S in one of a plurality of storage pockets formed in the upper column 16. The circular pin cushion mounting plate 12 is provided with a hemispherical shell 47 which has a top portion cut away to form an access opening for the cooperating threaded fasteners 43 and 45. The pin cushion 14 may be formed from a sponge rubber material having a suitable fabric covering. The pin cushion 14 has an arcuate convex curvature and includes a generally hemispherical recess dimensioned for engagement over the hemispherical shell 47. A planar bottom surface of the pin cushion 14 is supported on the upper surface of the plate 12. The flared upper end 37 of the upper axial rod section 31 provides a stable supporting surface for the plate 12, and is dimensioned to be received within the downwardly extending cylindrical boss 41 formed on the bottom surface of the plate 12. It should be noted that oppositely extending cylindrical bosses 35 and 27 are formed respectively on upper and lower surfaces of the bottom wall 26 of the upper storage tray 24. The upper flared end 29 of the lower axial rod section 23 is received within the boss 27 and provides a stable supporting surface for the upper tray 24. It should be noted that the frictional interlocking engagement of the cylindrical bosses 21, 27, 35 and 41 with the oircular apertures formed in the end walls of the vertical columns 16 and 17 further enhance the stability of the device, while providing for convenient assembly. It should be noted that FIG. 8 illustrates an alternative rotatable bearing assembly in which the cylindrical stub configuration illustrated in FIG. 7 has been omitted. In this construction, the ball bearings 40 are of the caged type and as such are mounted for rotation on the bearing cage plate 38, which is secured on the upper surface 36 of the frusto conical base plate 34. The lower storage tray 30 has a bottom surface provided with a frusto conical depression formed by a downwardly and outwardly inclined floor 31. This configuration protects the bearing assembly from contamination by dirt, thread scraps, and other foreign material.

As may now be understood, the present invention provides an improved carousel tYpe sewing accessory storage unit which allows a large number of sewing accessory items to be stored for convenient usage in a highly organized manner, in a minimum amount of space.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed as being new and desired to be protected by Letters Patent of the United States is as follows:

1. A sewing accessory storage device, comprising:
a stationary base;
a lower storage tray mounted for rotation on said base;
a lower column secured to said lower storage tray and extending vertically upwardly therefrom;
an upper storage tray secured to an upper end of said lower column;
an upper column secured to said upper storage tray and extending vertically upwardly therefrom;
a pin cushion secured to an upper end of said upper column;
an upstanding cylindrical boss formed centrally on an interior floor of said lower storage tray;
a plurality of vertical radially extending circumferentially spaced dividers in said lower storage tray;
said lower column having a hollow cylindrical configuration including a bottom end wall provided with a circular aperture in frictional engagement with said upstanding cylindrical boss;
said upper cylindrical storage tray having a circular bottom wall;
a pair of coaxial cylindrical bosses extending in aligned relation in opposite axial directions from upper and lower surfaces of said circular bottom wall;
and
a circular aperture provided in an upper end of said lower column, said circular aperture in frictional engagement with said circular boss extending from said lower surface of said circular bottom wall of said upper storage tray.

2. The sewing accessory storage device of claim 1, further comprising a first axial rod section having a first end secured centrally to said interior floor surface of said lower storage tray and a second flared end in abutment with said lower surface of said circular bottom wall of said upper storage tray, said flared end disposed coaxially within said cylindrical boss.

3. The sewing accessory storage device of claim 2, wherein said upper column has a hollow cylincrical configuration including a bottom end wall provided with a circular aperture in frictional engagement with said cylindrical boss on said upper surface of said circular bottom wall of said upper storage tray.

4. The sewing accessory storage device of claim 3, further comprising a second axial rod section having a first end in threaded engagement with said second end of said first axial rod section and a second flared end.

5. The sewing accessory storage device of claim 11, further comprising:
a circular plate having a bottom surface provided with a downwardly extending cylindrical boss;
and
said upper cylindrical column having a top end provided with a circular aperture in frictional engagement with said cylindrical boss on said circular plate.

6. The sewing accessory storage device of claim 5, further comprising cooperating threaded fasteners secured said second end of said second axial rod section to said circular plate.

7. The sewing accessory storage device of claim 6, further comprising a partial hemispherical shell on an upper surface of said circular plate, said shell having an open top portion providing access to said cooperating threaded fasteners.

8. The sewing accessory storage device of claim 7, further comprising a resilient convexly curved pin cushion having a generally hemispherical recess in engagement with said shell, said pin cushion having a planar bottom surface secured to an upper surface of said plate.

9. The sewing accessory storage device of claim 8, further comprising a plurality of downwardly and inwardly inclined scissor storage pockets spaced axially and circumferentially on said upper column.

10. A sewing accessory storage device, comprising:

a frusto conical stationary base plate having a circular top surface;

a caged ball bearing assembly secured centrally on said circular top surface of said base plate;

a lower cylindrical storage tray having a frusto conical depression formed in a bottom surface, said frusto conical depression forming a downwardly and outwardly inclined interior floor surface;

a bearing race centrally scured on said bottom surface of said lower storage tray;

a downwardly extending cylindrical stub on said bearing race;

a journal bore in said caged ball bearing assembly;

said cylindrical stub received for rotation in said journal bore;

a snap ring around said cylindrical stub retaining said cylindrical stub in said journal bore;

an upstanding cylindrical boss formed centrally on said interior floor of said lower storage tray;

a plurality of vertical radially extending circumferentially spaced dividers in said lower storage tray;

a lower cylindrical hollow column having a bottom end wall provided with a circular aperture in frictional engagement with said upstanding cylindrical boss;

an upper cylindrical storage tray having a circular bottom wall;

a pair of coaxial cylindrical bosses extending in aligned relation in opposite axial directions from upper and lower surfaces of said circular bottom wall;

a circular aperture provided in an upper end of said lower column, said circular aperture in frictional engagement with said circular boss extending from said lower surface of said bottom wall of said upper storage tray;

a first axial rod section having a first end secured centrally to said interior floor surface of said lower storage tray and a second flared end in abutment with said lower surface of said circular bottom wall of said upper storage tray, said flared end disposed coaxially within said cylindrical boss; said first end of said first axial rod section is disposed in threaded engagement with said cylindrical stub;

an upper cylindrical hollow column having a bottom end wall provided with a circular aperture in frictional engagement with said cylindrical boss on said upper surface of said bottom wall of said upper storage tray;

a second axial rod section having a first end in threaded engagement with said second end of said first axial rod section and a second flared end;

a circular plate having a bottom surface provided with a downwardly extending cylindrical boss;

said upper cylindrical column having a top end provided with a circular aperture in frictional engagement with said cylindrical boss on said circular plate;

cooperating threaded fasteners secured said second end of said second axial rod section to said circular plate;

a partial hemispherical shell on an upper surface of said circular plate, said shell having an open top portion providing access to said cooperating threaded fasteners;

a resilient convexly curved pin cushion having a generally hemispherical recess in engagement with said shell, said pin cushion having a planar bottom surface secured to an upper surface of said plate;

a pluality of downwardly and inwardly inclined scissor storage pockets spaced axially and circumferentially on said upper column;

and a plurality of bobbin supporting spindles spaced about said upper surfasce of said bottom wall of said upper storage tray.

* * * * *